United States Patent [19]

Simpson et al.

[11] 4,005,560

[45] Feb. 1, 1977

[54] REINFORCED CONCRETE APPLIANCE

[75] Inventors: Herbert John Simpson, Andover, England; Walter Heller, Horgen, Switzerland

[73] Assignee: Preformed Line Products Company, Cleveland, Ohio

[22] Filed: Oct. 31, 1975

[21] Appl. No.: 627,614

Related U.S. Application Data

[63] Continuation of Ser. No. 506,263, Sept. 16, 1974, abandoned, which is a continuation of Ser. No. 329,580, Feb. 5, 1973, abandoned.

[30] Foreign Application Priority Data

Feb. 11, 1972 United Kingdom ..... 6437/72

[52] U.S. Cl. ..... 52/677; 52/712

[51] Int. Cl.[2] ..... E04C 5/18

[58] Field of Search ..... 52/687, 688, 689, 712; 24/115 N, 131 C; 174/DIG. 12, 173

[56] References Cited

UNITED STATES PATENTS

| | | | |
|---|---|---|---|
| 1,121,639 | 12/1914 | Lampert | 52/689 |
| 1,841,720 | 1/1932 | Emieholz | 52/687 |
| 2,959,632 | 11/1960 | Peterson | 174/DIG. 12 |
| 2,965,701 | 12/1960 | Kitselman | 174/DIG. 12 |
| 3,133,985 | 5/1964 | Nordstrom | 174/173 |

FOREIGN PATENTS OR APPLICATIONS

| | | | |
|---|---|---|---|
| 11,765 | 5/1909 | United Kingdom | 52/652 |

*Primary Examiner*—Price C. Faw, Jr.
*Assistant Examiner*—William Randolph
*Attorney, Agent, or Firm*—Meyer, Tilberry & Body

[57] ABSTRACT

An appliance for holding concrete reinforcing rods either in relation to each other or spaced relative to a mold surface while the plastic concrete is being poured and hardens. The appliance consists of a wire or rod having a portion helically preformed to have a pitch and internal diameter so that it can be wrapped around the reinforcing rod without exceeding it's elastic limit to tightly grip the rod and a laterally-extending portion which may either engage the surface or be helically preformed to be wrapped around another rod.

4 Claims, 15 Drawing Figures

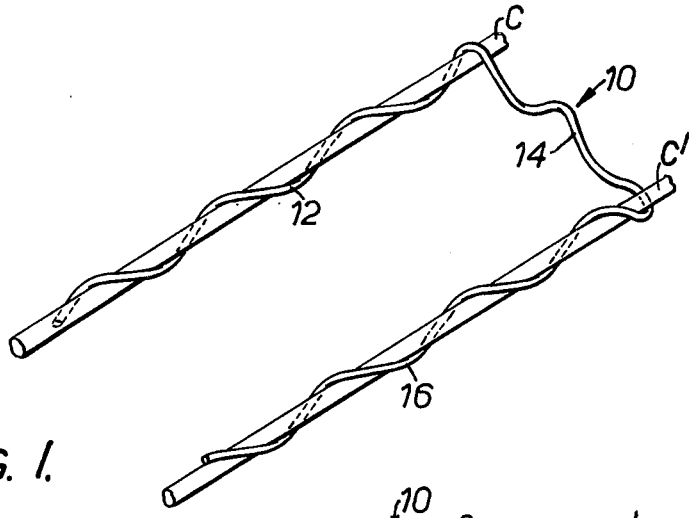
FIG. 1.
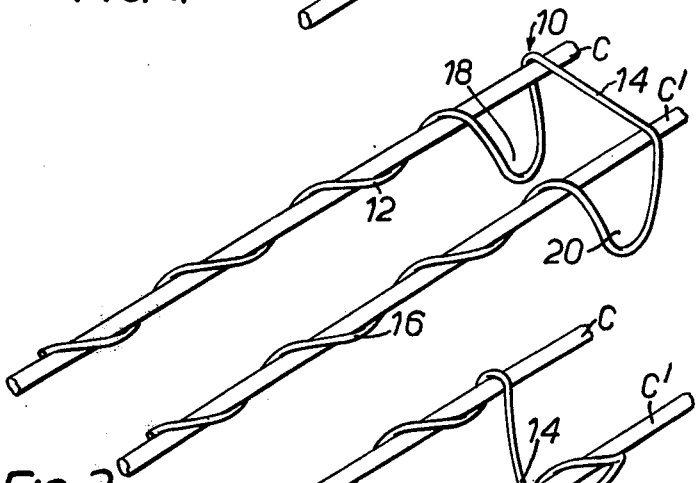
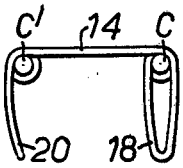
FIG. 2A.
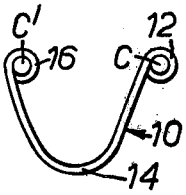
FIG. 3A.
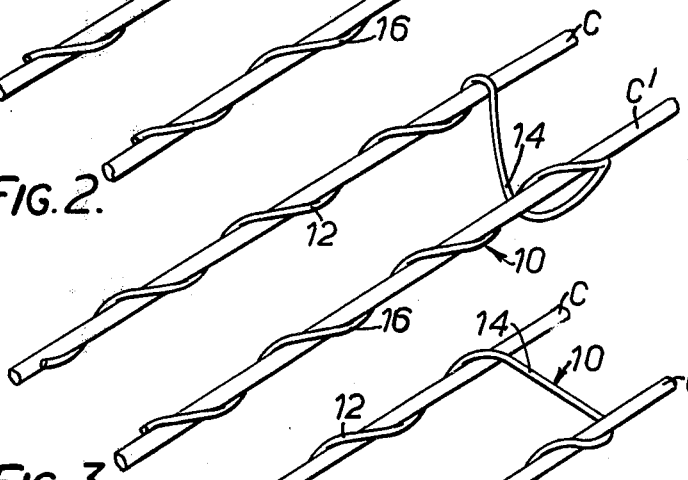
FIG. 2.
FIG. 3.
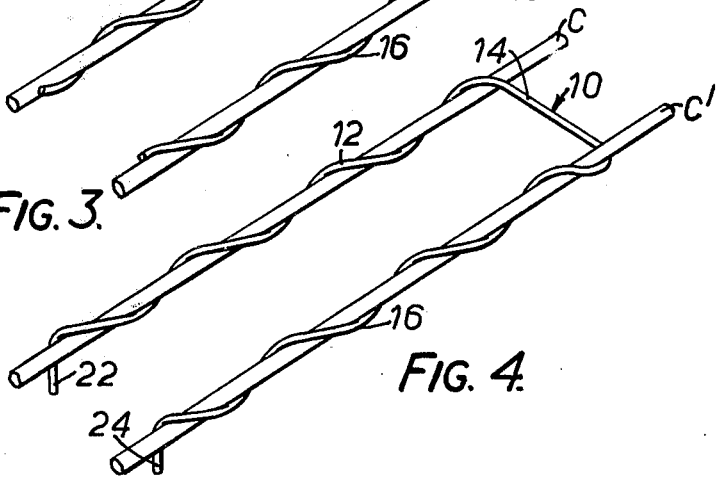
FIG. 4.

REINFORCED CONCRETE APPLIANCE

This is a continuation of application Ser. No. 506,263 filed Sept. 16, 1974, now abandoned, and which application in turn is a continuation of application Ser. No. 329,580 filed Feb. 5, 1973 and now abandoned.

This invention relates to an appliance for use with one or more elongate reinforcement members to be embedded in cast material. The invention is particularly, but not exclusively, applicable to casting concrete with reinforcement strands embedded in it.

In the art of casting reinforced concrete, difficulty has been experienced in the past in holding the reinforcing members in spaced relationship to the surfaces confining the plastic concrete while it is being cast and/or setting up. For example, in pouring floors, it has been customary for a laborer to walk into the plastic concrete, reach through the mass and physically raise the reinforcing member from its engagement with the bottom surface. Another problem has been in holding the reinforcing members in the desired physical relationship to each other while the concrete is being poured into position.

The present invention overcomes these difficulties in a novel and inexpensive way.

Thus, the invention provides an appliance for holding one reinforcement member relative to another member during casting. One embodiment of the invention is a spacer, for maintaining a desired spacing between the reinforcement member and the wall, floor, or bed of a mould or form in which casting occurs, or between the reinforcement member and an adjacent reinforcement member. Another embodiment of the invention is designed to hold the reinforcement member against another member, which may be a crossing reinforcement member, as in a mesh or grid.

In accordance with the invention there is provided a method of producing a cast body having at least one elongate reinforcement member embedded in it, comprising providing a resilient appliance having a helically preformed first part and a second part, positioning said appliance with said first part disposed around and gripping said reinforcement member and with said second part engaging a further member which is disposed laterally of said reinforcement member to hold said further member and said reinforcement member in their relative positions, embedding said appliance and said reinforcement member in casting material and causing or permitting said casting material to set. The method is particularly applicable to casting reinforced concrete bodies, but is also applicable to other casting materials.

Further in accordance with the invention, spacing appliance is provided for maintaining the spacing of one elongated reinforcement member relative to another member during the casting of concrete comprised of: a first part helically preformed to a diameter such as to grip the reinforcement member and a pitch length that it can be disposed therearound without exceeding its elastic limit; and a second part spaced laterally from the helix axis for engagement with said other member to hold the members in their desired relative positions while plastic concrete is being poured therearound. The appliance is preferably of steel; for casting concrete, it may be made of stainless steel, which may be particularly useful if the appliance emerges at the surface of the cast body. For casting synthetic plastics materials, the appliance may itself be made of, or coasted with, plastics material, and may be resin-bonded glass fibre, for example.

The appliance may be a spacer, for maintaining spacing between the reinforcement member and the further member. The further member may be a part of a mould wall for the cast material, or a bed or floor onto which the cast body is to be formed. For example, in casting concrete, spacers of this kind may be used to space reinforcement rods from the form or from the mould floor or from a bed while concrete is being poured in and setting. For this purpose, said second part of the appliance preferably comprises a loop or projection extending laterally of said first part to abut said further member.

Alternatively or additionally the appliance may be a spacer for maintaining spacing between said reinforcement member and a further reinforcement member. Said second part is then preferably also helically preformed in the same manner as the first part for wrapping around and gripping said further reinforcement member. The two reinforcement members may be parallel, in which case said appliance is preferably preformed to a U or C shape, the first and second parts being generally parallel limbs of the U or C, or to a zig-zag shape, the first and second parts again being generally parallel limbs. The part or parts joining the limbs may be straight or may also be helically preformed. The first and second parts of the appliance are preferably of the same helix diameter, pitch length, and hand of lay, if the reinforcement members are similar, and the appliance is preferably made by bending and cutting initially continuously helical stock, part of which may also be untwisted if desired to form non-helical portions. If the reinforcement members are of different diameter, the internal diameters and pitch lengths of the helices are preferably made correspondingly different, however.

The appliances can alternatively be designed to hold together two crossing reinforcement members (one of which is the further reinforcement member referred to above). Such appliances can be used where a number of reinforcement members form a grid for example. The appliance is conveniently formed in an L-shape, with said first and second parts helically preformed to wrap around and grip the crossing reinforcement members. Alternatively, the appliance may comprise one or more elements whose longitudinal axis is generally straight, said second part comprising a loop portion on each element for looping over the reinforcement member, which loop portion may be intermediate two similar helically preformed portions, one of which portions is said first part, or the loop portions may be at one end, forming a hook.

The inner diameter of each helical portion of each appliance should be slightly less than the outer diameter of the reinforcement member to which it is applied, and the pitch length should be great enough so that it may be applied to the reinforcement member by being wound around it from one side without exceeding its elastic limit (i.e., there is no permanent deformation of the appliance to obtain a suitable grip.)

The reinforcement member may be a generally cylindrical rod, but if it is a cabled strand the hand of lay of the helical portion of the appliance is preferably the same as the strand and the pitch length may be slightly different to (preferably less than) the pitch length of the strand, to obtain maximum resistance to relative longitudinal movement of the appliance on the strand.

The grip of the appliance is preferably enhanced by grit or other abrasive applied to the inside of the helix or the serrations on the inside of the helix where it engages the reinforcement member.

The appliance may consist of a single rod or ribbon or of a ribbon comprised of a plurality of rods disposed side by side and intertwisted with each other, in which case the rods are preferably glued or otherwise secured together.

Features and advantages of the invention will appear from the following description of embodiments thereof, given by way of example with reference to the accompanying drawings, in which:

FIG. 1 is a schematic perspective view of a spacer appliance applied to two reinforcement rods to maintain spacing between the rods;

FIGS. 2 to 5 are schematic perspective views of other appliances applied to two reinforcement rods to maintain a predetermined spacing between the rods and also maintain a predetermined spacing from each of the rods to a bed or a floor of a mould, FIGS. 2A and 3A being end views of the appliances shown in FIGS. 2 and 3;

Figure 5:
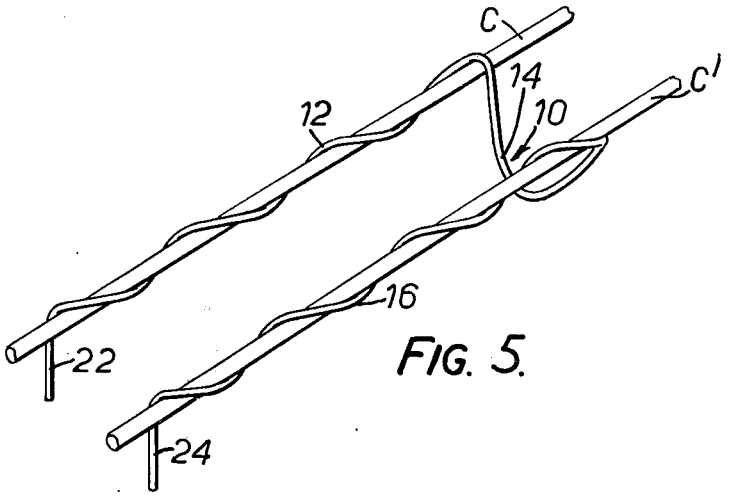

Referring now to the drawings in more detail, the drawings show appliances for use with iron reinforcement rods and grids C,C′ which are positioned in a form or mould while concrete is poured into the form or mould to embed the rods and appliances in the concrete, the concrete being then allowed to set. The appliances are not necessarily intended to provide reinforcement for the concrete themselves, although they could be designed to do so, but to hold the reinforcement rods C,C′ in place. The rods C,C′ will normally be disposed in a flat array, where the case concrete body is to form floor, ceiling or wall material. Other shaped arrays are also possible where prefabricated concrete sections are made. The rods C,C′ may be disposed in cylindrical arrays, in pilings for example.

The appliance shown in FIG. 1 comprises a helically preformed element, generally of U-shape. The element comprises a leg 12 which is wrapped around one reinforcement rod C, a bridging portion 14 whose longitudinal axis extends perpendicular to the longitudinal axis of the leg 12 and the rod C and bridges the gap between the rods C and C′, and a further leg 16, parallel to the leg 12, and wrapped around the rod C′. The legs 12 are of an elastic flexible material preformed to a helix having an internal diameter preferably just less than the diameter of rods C and of an open pitch such that the leg can be wrapped around the rod C without exceeding its elastic limit. The corners between the bridging portion 14 and the legs 12 and 16 are arranged to lie flat on the rods by positioning them at an appropriate phase of the helices of the legs 12 and 16. If the bridging portion 14 is helically preformed, as shown, its length must be substantially an integral number of half pitch lengths of the helices. However, it is possible for the bridging portion to be straight, as indicated with reference to FIG. 2. This may be achieved even if the appliance is made from stock which is initially helically preformed throughout its length, by untwisting the helices in the bridging portion 14 during manufacture. Other manufacturing methods can be used, however. If the bridging portion 14 is straight, this reduces the compliance of the spacer.

Although the appliance is shown as consisting of a single element 10, it can also be formed from a ribbon comprising a plurality of similar elements 10 disposed side by side and intertwisted.

In a typical application, the rods C and C′ have a diameter of 12mm and are spaced by 100mm. The helices of the element 10 have an inside diameter of 9.5mm and are formed of hard steel. Similar appliances are disposed at intervals of 1 – 2m along the rods C and C′.

The appliance shown in FIG. 2 is similar to that shown in FIG. 1 except that the bridging portion 14 is straight. Also, loop 18 and 20 depend from the legs 12 and 16, at the corners between the legs and the bridging portion 14. The loops 18 and 20 engage the mould floor or the bed of the concrete member to be poured, to maintain the spacing between the rods C and C′ and the floor or bed during casting. Thus, the appliance serves not only to space the members C and C′ from each other but also from the floor or bed.

The appliance shown in FIG. 3 is formed with a loop 14′ depending in the bridging portion 14 to engage the mould floor or bed.

The rods C and C′ may have surface grooves and ridges, as shown in FIGS. 2 and 3, so as to key better into the casting material.

The appliance as shown in FIG. 4 has projections 22 and 24 depending at the free end of the legs 12 and 16 forming feet for engaging the mould floor or bed. In this appliance the bridging portion 14 is straight, but in an otherwise similar appliance shown in FIG. 5, the bridging portion 14 is formed with a depending loop for also engaging the mould floor or bed.

Figure 6:
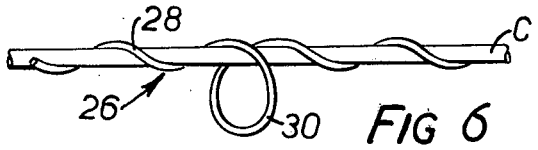
FIG. 6 is a schematic side view of an appliance applied to a reinforcement rod to maintain a spacing between the rod and a wall or floor of a mould.

The appliance 26 shown in FIG. 6 comprises a single helically preformed element 28 with a loop forming a closed bight 30 intermediate its ends depending from the rod C to engage the mould floor or bed. The appliance 26 has legs of a sufficiently small internal helix diameter to grip the rod C without risk of rotation relative to it once the appliance has been applied and is used in circumstances where the rod C is not rotatable relative to the mould floor or bed. A bight such as 30 can also be used in an appliance of the kind shown in FIGS. 4 and 5 in substitution for the projections 22 and 24.

Figure 7:
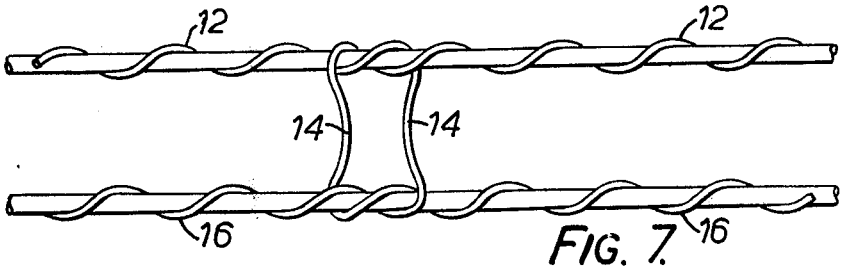
FIGS. 7 to 9 are schematic plan views of appliances applied to two reinforcement rods to maintain spacing between the rods.

As shown in FIG. 7 the appliance may comprise a pair of elements 10 arranged with their legs partly overlapping and intertwisted or with the bridging portions 14 intertwisted.

Figure 8:
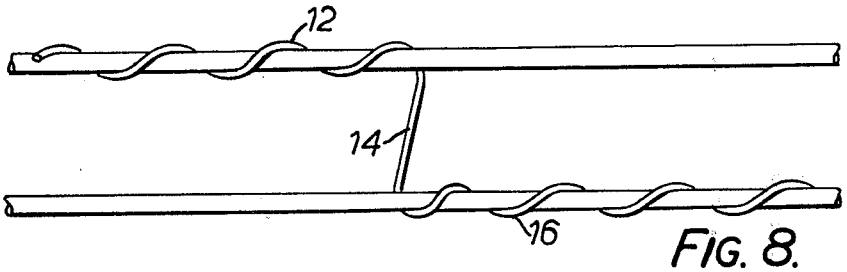

The appliance shown in FIG. 8 comprises an element 32 of zig-zag shape in which the legs 12 and 16 are parallel but extend in opposite directions from the bridging portion 14. A pair of the elements 32 may be used together with the bridging portions 14 overlapping and the legs 12 and 16 dispose one after the other.

Figure 9:
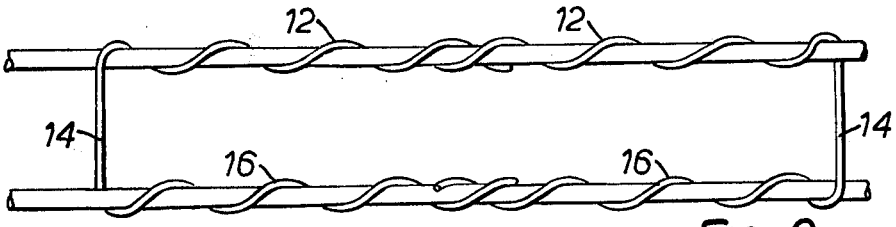

As shown in FIG. 9, it may be convenient to dispose two elements such as 10 with their legs only just overlapping. This concept leads to a modified appliance (not shown) in which the two elements 10 are combined, with one leg of each appliance integrally formed, to produce a composite device of C-shape.

Figure 10:
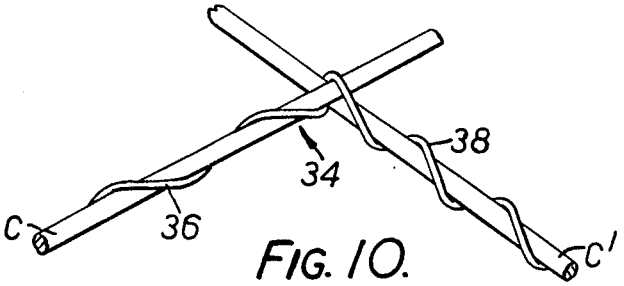
FIGS. 10 and 11 are schematic perspective views of appliances applied to two crossing reinforcement rods to hold the rods together.

FIG. 10 shows an appliance 34 comprising legs 36 and 38 having perpendicular longitudinal axes arranged in an L-shape. This appliance is used to hold together two crossing reinforcement members C and C′, such as is found in a grid. The shape of the corner may be chosen to suit the particular desired attachment and support characteristics. Once again, the corner between the two legs is chosen so as to lie flat on the rods by suitably positioning it relative to the phase of the helices in the legs. A pair of elements 34 may be used together in a T or cruciform configuration.

Figure 11:
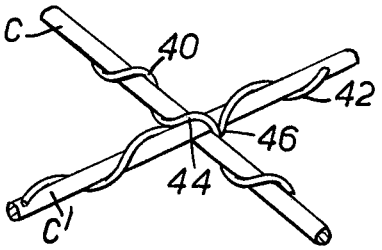

The appliance shown in FIG. 11 comprises a pair of helically preformed elements 40 and 42. These elements are applied to grip respective reinforcement rods C and C′ which cross, and have intermediate portions 44 and 46 which are arranged to pass over the other reinforcement rod of the pair so as to hold the reinforcement rods together. Conveniently the intermediate portions 44 and 46 are looped, to accommodate the intersecting rods C′ and C.

Figure 12:
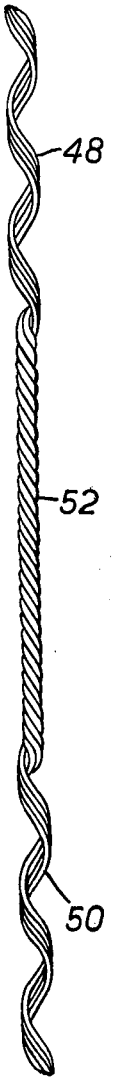
FIGS. 12 and 13 are plan views of yet another appliance, respectively before and after it is applied to two rods to form a stirrup bridging the rods.
Figure 13:
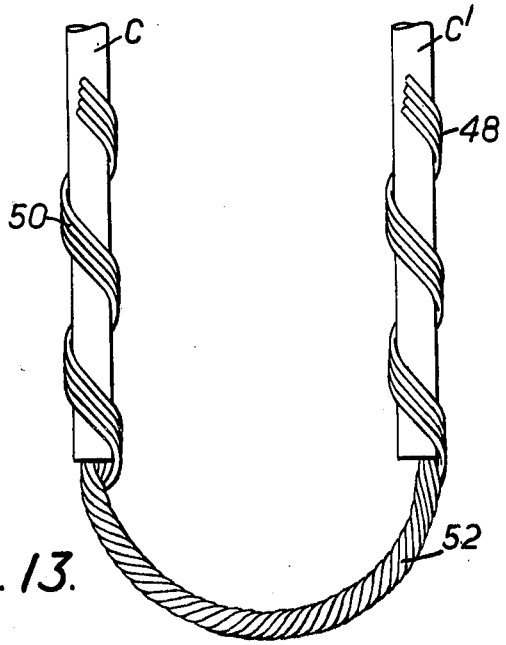

The appliance shown in FIGS. 12 and 13 comprises legs 48 and 50 of open helical configuration, and an intermediate portion 52 in which the helices are tightly twisted. The legs 48 and 50 are applied to grip the adjacent ends of reinforcement rods C and C′ to form a stirrup bridging the ends of the rods. This appliance not only holds the rods C and C′ in spaced relationship before being embedded in the casting material, but also serves as a substantial part of the reinforcement structure. It is convenient to strengthen the appliance, as shown, by forming it from a band comprising a plurality of intertwisted rods, preferably secured together by adhesive.

Having thus described our invention, we claim:

1. An appliance for holding a pair of elongated non-coaxial reinforcement members for a cast material relative to one another and spaced from the surface of a form while said material is being cast and is hardening, said appliance comprising: a pair of resilient non-coaxial legs each adapted to encircle and grip a corresponding one of said reinforcement members, each of said legs being helically preformed to a multi-turn helix having a predetermined internal diameter and an open pitch, said internal diameter of each helix being less than the external diameter of the corresponding reinforcement member and said pitch of each helix being long enough that the leg can be wrapped around the corresponding reinforcement member without exceeding the elastic limit of the material from which the appliance is made, the axes of said legs lying in a common first plane, said legs having first ends spaced apart and interconnected by a bridging portion lying in a second plane extending through said first ends perpendicular to said first plane, said bridging portion including opposite ends each integral with one of said first ends of said legs and a form surface engaging portion extending between said opposite ends and spaced from said legs to engage said form surface and space said legs therefrom, each said leg gripping the corresponding reinforcement member against displacement relative thereto and said bridging portion being entirely spaced from said reinforcement members and maintaining said legs in said non-coaxial relationship, whereby said legs and bridging portion cooperatively position said reinforcement members relative to one another and space said reinforcement members from said form surface.

2. The appliance according to claim 1, wherein said form surface engaging portion is U-shaped and includes a large radius curved portion between said opposite ends of said bridging portion.

3. The appliance according to claim 1, wherein said axes of said legs are parallel and laterally spaced apart in said first plane and said second plane is perpendicular to said axes.

4. The appliance according to claim 3, wherein said form surface engaging portion is U-shaped and includes a large radius curved portion between said opposite ends of said bridging portion.

* * * * *

UNITED STATES PATENT AND TRADEMARK OFFICE

CERTIFICATE OF CORRECTION

PATENT NO. : 4,005,560

DATED : February 1, 1977

INVENTOR(S) : Herbert John Simpson Braime and Walter Heller

It is certified that error appears in the above–identified patent and that said Letters Patent are hereby corrected as shown below:

Front page, data entry [75], line 1, after "Simpson" insert --- Braime ---.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*